US009370228B2

(12) United States Patent
Chang

(10) Patent No.: US 9,370,228 B2
(45) Date of Patent: Jun. 21, 2016

(54) COMBINATION TYPE BAG

(71) Applicant: Teng-Yao Chang, Taichung (TW)

(72) Inventor: Teng-Yao Chang, Taichung (TW)

( * ) Notice: Subject to any disclaimer, the term of this patent is extended or adjusted under 35 U.S.C. 154(b) by 320 days.

(21) Appl. No.: 14/223,503

(22) Filed: Mar. 24, 2014

(65) Prior Publication Data

US 2015/0265014 A1 Sep. 24, 2015

(51) Int. Cl.
*A45C 7/00* (2006.01)
*A45F 5/02* (2006.01)

(52) U.S. Cl.
CPC ..... *A45C 7/0059* (2013.01); *A45C 7/0077* (2013.01); *A45F 5/021* (2013.01)

(58) Field of Classification Search
CPC .... A45C 7/0059; A45C 7/0077; A45F 5/021; A45F 3/00; A45F 5/02; A45F 5/00; A45F 2005/008; A47G 23/0216; Y10S 224/908; Y10S 224/93; Y10S 224/929
See application file for complete search history.

(56) References Cited

U.S. PATENT DOCUMENTS 967,487 A * 8/1910 Baker ..... A45F 5/02 224/197
2,096,376 A * 10/1937 Lauppe ..... A45F 5/00 224/240
4,135,653 A * 1/1979 Sieloff ..... A45F 5/00 224/222
D293,857 S * 1/1988 Stout ..... 224/250
4,951,910 A * 8/1990 March ..... B60N 3/103 224/482
5,325,991 A * 7/1994 Williams ..... A45F 5/02 215/12.1
6,286,798 B1 * 9/2001 Chun ..... A47G 23/0216 206/218
6,364,187 B1 * 4/2002 Castellano ..... A45F 5/02 224/236
6,412,674 B1 * 7/2002 Lipke ..... A45C 7/00 224/235
6,533,150 B1 * 3/2003 Margo ..... A45F 5/021 224/148.1
D517,314 S * 3/2006 Moyer ..... D3/229
7,640,632 B2 * 1/2010 Lazarus ..... A45C 1/02 150/143
8,573,458 B1 * 11/2013 Hamilton ..... A45F 5/021 224/250
2007/0205244 A1 * 9/2007 Hewes ..... A45F 5/02 224/674
2008/0121673 A1 * 5/2008 Timm ..... A45C 11/00 224/575
2008/0277436 A1 * 11/2008 Wilson ..... F41A 9/65 224/239
2009/0127304 A1 * 5/2009 Uygur ..... A45F 5/02 224/250

* cited by examiner

*Primary Examiner* — Tri Mai
(74) *Attorney, Agent, or Firm* — Ming Chow; Sinorica, LLC

(57) ABSTRACT

A combination type bag includes a main bag member, a coupling unit, a secondary bag member, and a connecting unit, wherein once the main bag member is combined with the secondary bag member through the connecting unit, a firm containing structure is formed. The coupling unit and the connecting unit are adjustable at their connecting/engaging locations, and therefore the capacity of the combination type bag could be varied along two dimensions (height and width). The structure of the combination type bag is rigidly constructed, which is unlikely to deform. Its capacity could be varied to meet the requirement of the user, and its rigid structure is suitable to be used under any circumstances.

9 Claims, 8 Drawing Sheets

COMBINATION TYPE BAG

BACKGROUND OF THE INVENTION

1. Technical Field

The present invention relates generally to a bag, and more particularly to a combination type bag.

2. Description of Related Art

There are various bags in ordinary life, such as handbags and backpacks, which have a fixed size to receive items therein. If one has an item of large size or a lot of items to carry, he/she needs a large bag. However, a large bag is inconvenient for user to carry, and furthermore, it usually does not have a good looking appearance.

There are some adjustable bags in the market, which use flexible material to make the bag extendable. The commonest flexible material for the adjustable bag is flexible fabric, which can be extended and folded. However, the flexible fabric cannot sustain heavy items. Therefore, the bags made of flexible fabric usually have the material fatigue problem after a long time of use, so most consumers still like bags made of hard materials. However, such bags have a fixed shape and size, which is not benefit for carrying items and storage of the bag.

BRIEF SUMMARY OF THE INVENTION

In view of the above, the primary objective of the present invention is to provide a combination type bag, which is able to adjust the size to receive items, and is capable of carrying heavy items.

The present invention provides a combination type bag, which includes a main bag member, a coupling unit, a secondary bag member, and a connecting unit. The main bag member is made of a flexible fabric, and has a first fabric portion, a second fabric portion, and two side fabric portion, wherein the first fabric portion is connected to an end of the second fabric portion, and the side fabric portions are connected to opposite ends of the second fabric portion symmetrically; the coupling unit has a first coupler and a second coupler detachably engaged with each other, wherein the first coupler is provided on the first fabric portion, and the second coupler is provided on the second fabric portion; the secondary bag member has a base fabric and a covering fabric connected with each other to form a space therebetween, wherein the secondary bag member has two openings to be entrances of the space; the connecting unit has two first connectors and a second connector detachably engaged with each other, wherein the first connectors are provided on the side fabric portions of the main bag member respectively, and the second connector is detachably provided on the base fabric of the secondary bag member and is in the space. The main bag member is folded to have the first fabric portion and the second fabric portion overlapped and the first coupler engaged with the second coupler; and then the side fabric portions are inserted into the space of the secondary bag member via the openings to have the first connectors engaged with the second connector.

Whereby, once the main bag member is combined with the secondary bag member through the connecting unit, a firm containing structure is formed. Since the coupling unit and the connecting unit are adjustable at their connecting/engaging locations, the combination type bag could have its capacity varied along two dimensions (height and width). The way the covering fabric covers the base fabric further restricts the disconnection direction between the first and the second connectors, which makes the combination type bag rigid and unlikely to deform.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
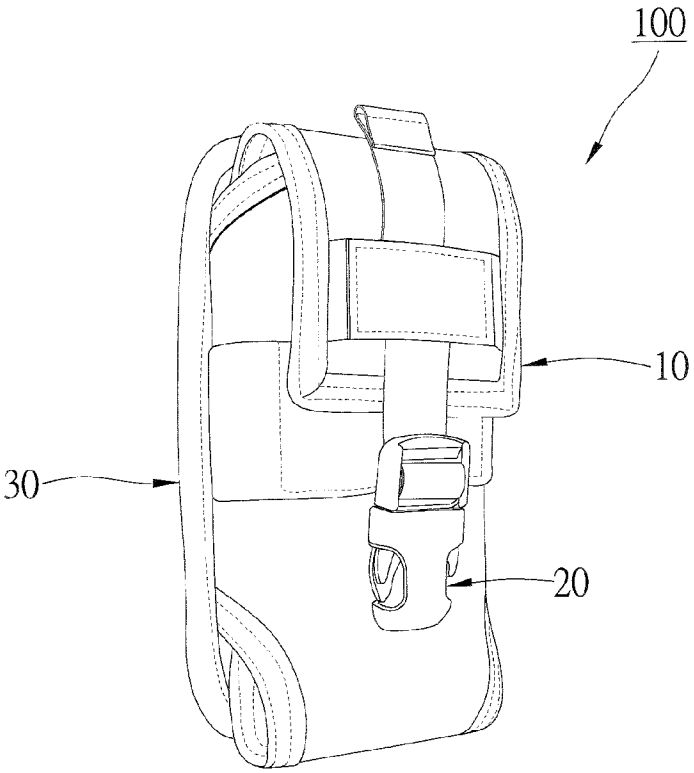
FIG. 1 is a front respective view of a first preferred embodiment of the present invention.

As shown in FIGS. from FIG. 1 to FIG. 8, a combination type bag 100 of the first preferred embodiment of the present invention includes a main bag member 10, a coupling unit 20, a secondary bag member 30, and a connecting unit 40.

Figure 3:
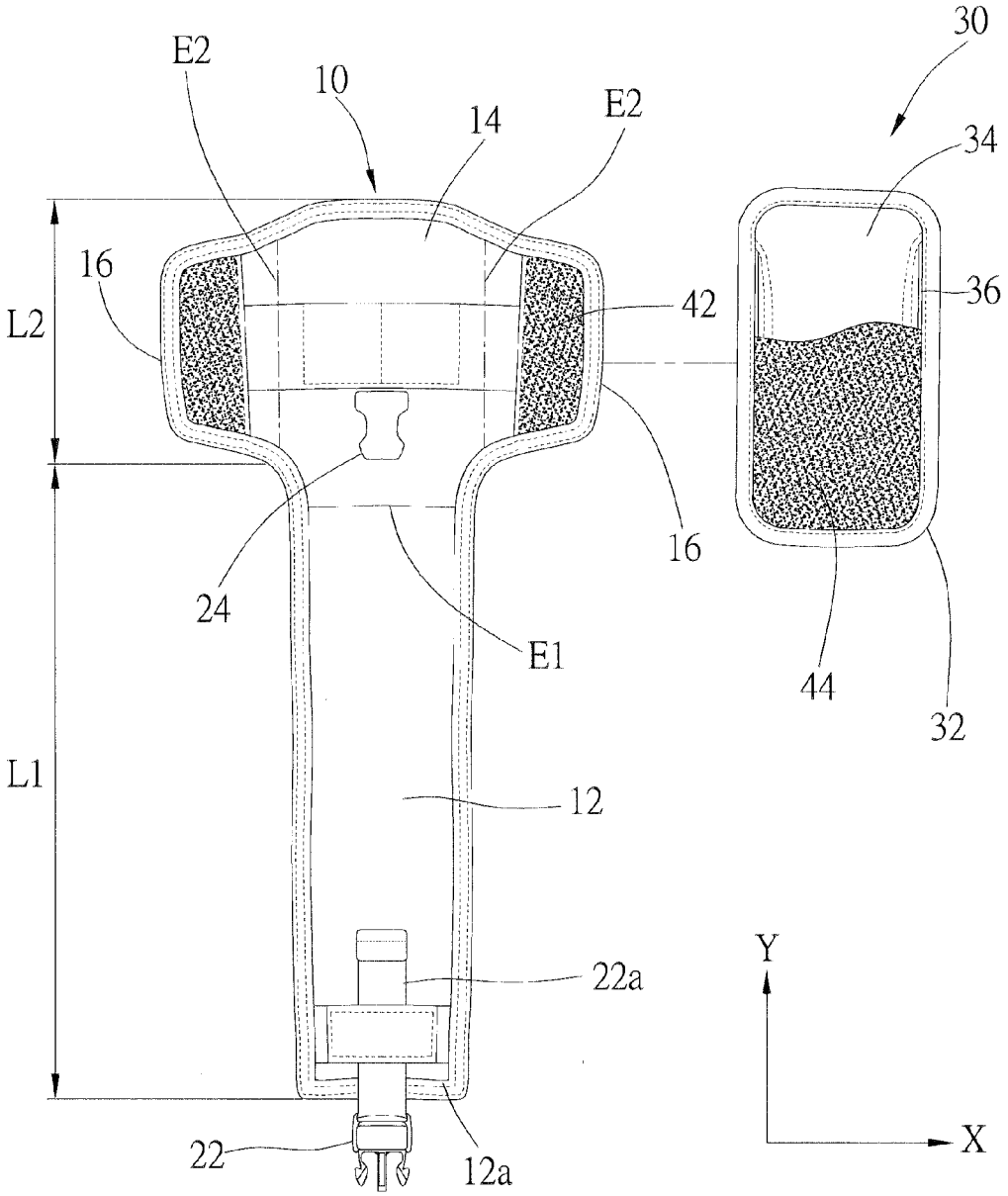
FIG. 3 is an expanded view of the first preferred embodiment of the present invention, showing the combination type bag with the Velcro device.
Figure 4:
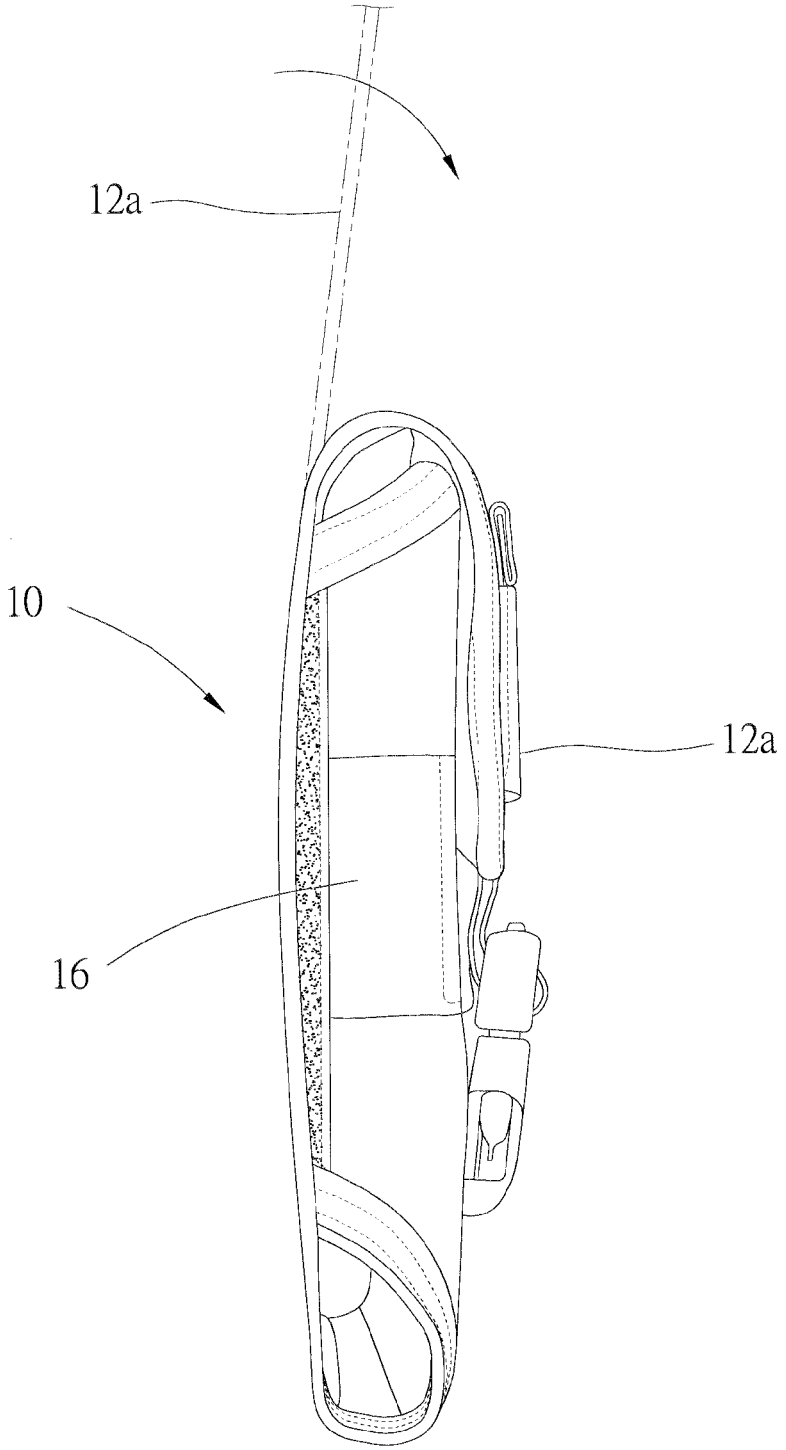
FIG. 4 is a left side view of the first preferred embodiment of the present invention, showing the folded main bag member.

The main bag member 10 is made of a flexible fabric, including a first fabric portion 12, a second fabric portion 14, and two side fabric portions 16, wherein the first fabric portion 12 is connected to the second fabric portion 14, as shown in FIG. 3. A length L1 of the first fabric portion 12 along a Y axis is longer than a length L2 of the second fabric portion 14 along the Y axis, and it is preferable that L1 is at least 1.5 times longer than L2. A first folding line E1 is formed at a junction of the first fabric portion 12 and the second fabric portion 14. The side fabric portions 16 are connected to opposite sides of the second fabric portion 14 symmetrically, and two second folding lines E2 are formed at a junction of each side fabric portion 16 and the second fabric portion 14.

The coupling unit 20 includes a first coupler 22, a second coupler 24 and a belt. In an embodiment, the first coupler 22 and the second coupler 24 are a plug and a socket of a side release buckle, wherein the plug is inserted into the socket for engagement. The belt 26 has an end connected to the first fabric portion 12, and the first coupler 22 is movably mounted on the belt 26. The second coupler 24 is connected to the second fabric portion 14 to engage the first coupler 22.

The secondary bag member 30 has a base fabric 32 and a covering fabric 34. The base fabric 32 and the covering fabric 34 are two rectangular fabric sheets, but the covering fabric 34 is slightly smaller than the base fabric 32. An edge of the covering fabric 34 is sewed onto the base fabric 32, so that the secondary bag member 30 has a space between the base fabric 32 and the covering fabric 34. Two portions of the edge of the covering fabric 34 are not sewed onto the base fabric 32 to form two openings 36. The openings 36 are located at opposite sides to be entrances of the space.

The connecting unit 40 includes two first connectors 42 and a second connector 44. In an embodiment, the first and the second connectors 42, 44 are loops and hooks of Velcro. The first connectors 42 are provided on the side fabric portions 16 respectively, and the second connector 44 is provided on the base fabric 32. Precisely, the second connector 44 is provided on an inner side of the base fabric 32, which means the second connector 44 is in the space of the secondary bag member 30.

Figure 5:
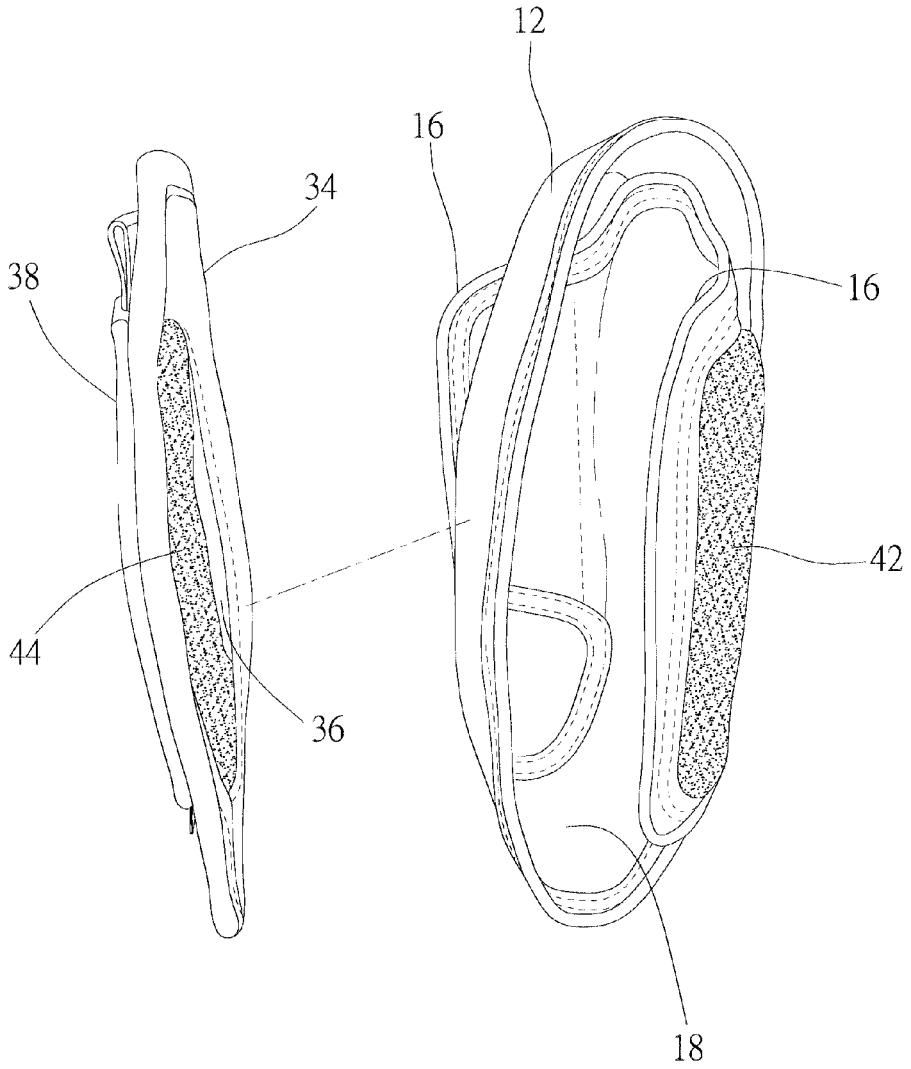
FIG. 5 is an exploded view of the first preferred embodiment of the present invention, showing the separating main and secondary bag members.
Figure 6:
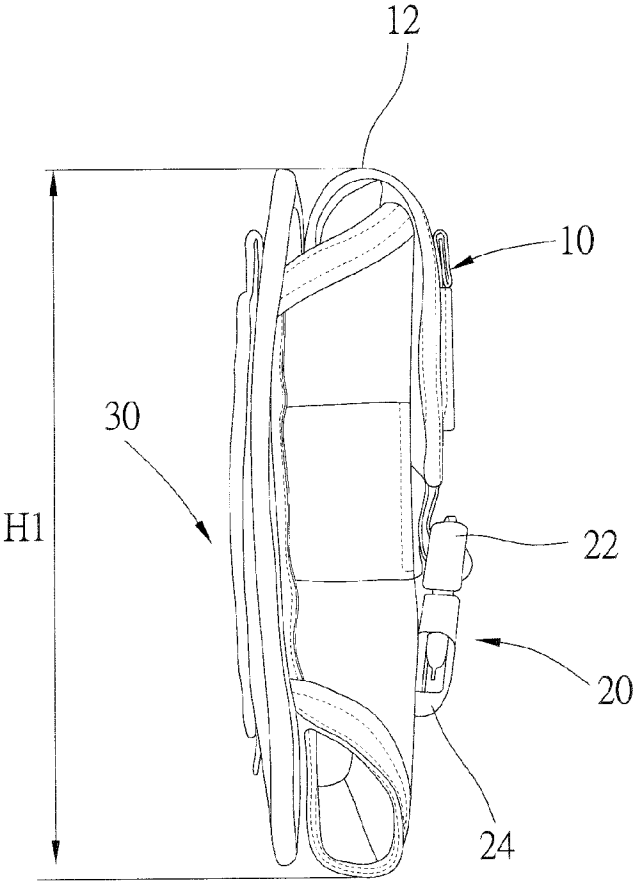
FIG. 6 is a left side view of the first preferred embodiment of the present invention, showing the combination type bag with shorter height.

To assemble the combination type bag 100, a user has to fold the main bag member 10 along the first folding line E1 to have the first fabric portion 12 overlapped the second fabric portion 14 first. The first fabric portion 12 has a free portion 12*a* which is beyond the second fabric portion 14. Next, fold the free portion 12*a* to attach it to an outer side of the second fabric portion 14, and then engage the first coupler 22 with the second coupler 24 to secure the main bag member 10. At this time, the main bag member 10 is a loop-shaped member with two gaps 18 at opposite ends. Next, by folding the side fabric portions 16 along the second folding lines E2 respectively, and then inserting the side fabric portions 16 into the openings 36 of the secondary bag member 30, which attaches the covering fabric 36 to an outer side of the first fabric portion 12, the first connectors 42 is engaged with the second connector 44 (FIG. 5). Now the gaps 18 are covered by the side fabric portions 16, and a containing structure of the combination type bag 100 is formed. One may disengage the first coupler 22 with the second coupler 24 to open the combination type bag 100 to put into into a space therein, and close the combination type bag 100 by engaging the first coupler 22 with the second coupler 24.

Figure 7:
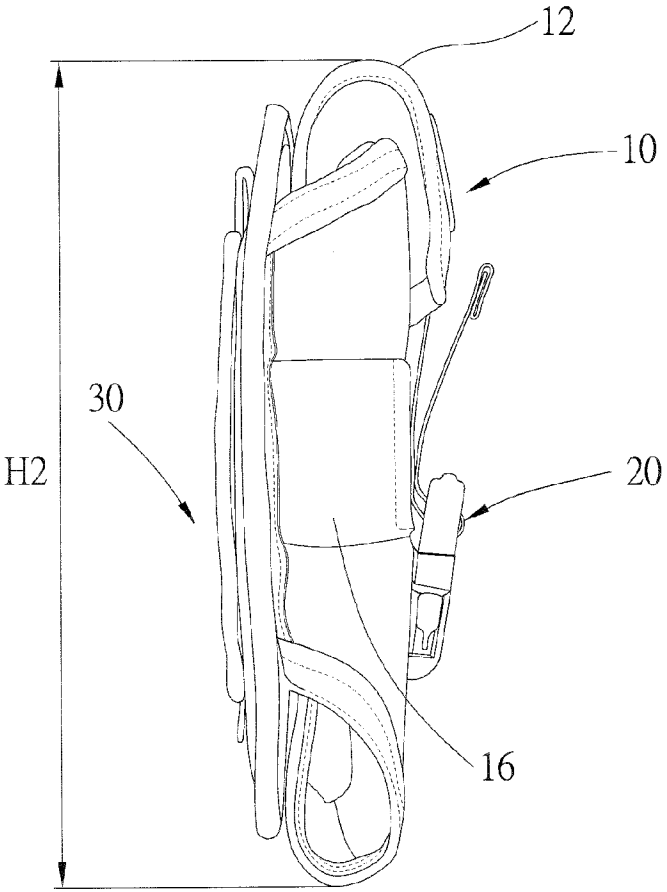
FIG. 7 is a left side view of the first preferred embodiment of the present invention, showing the combination type bag with longer height.
Figure 8:
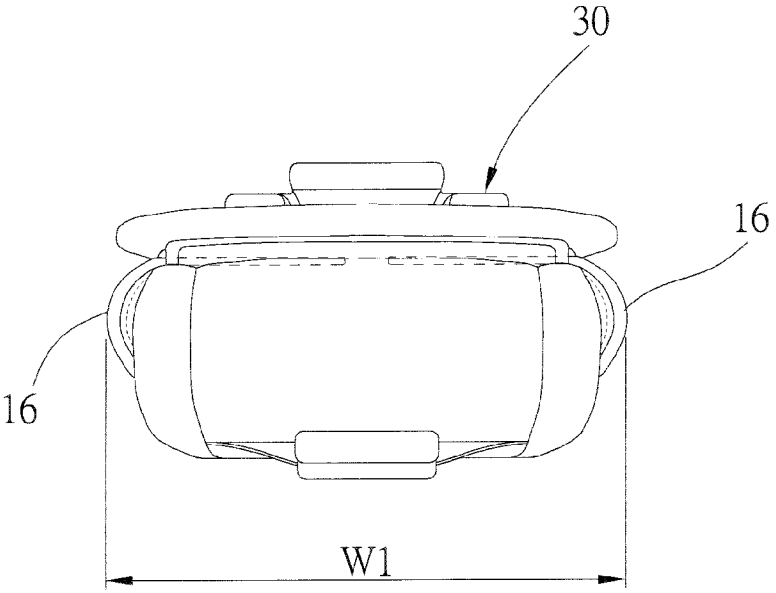
FIG. 8 is a top side view of the first preferred embodiment of the present invention, showing the combination type bag with narrow width.

A height of the combination type bag 100 is adjustable by changing the location of the first coupler 22 on the belt 26. The height H1 of the combination type bag 100 decreases if the first coupler 22 is shifted toward a proximal end of the belt 26, since it is the end of the belt 26 connected to the first fabric portion 12 (FIG. 6); the height H2 increases if the first coupler 22 is shifted along an opposite direction (FIG. 7). In other words, the height of the combination type bag 100 is adjustable by changing a length of the belt 26 between the first coupler 22 and the first fabric portion 12.

Figure 9:
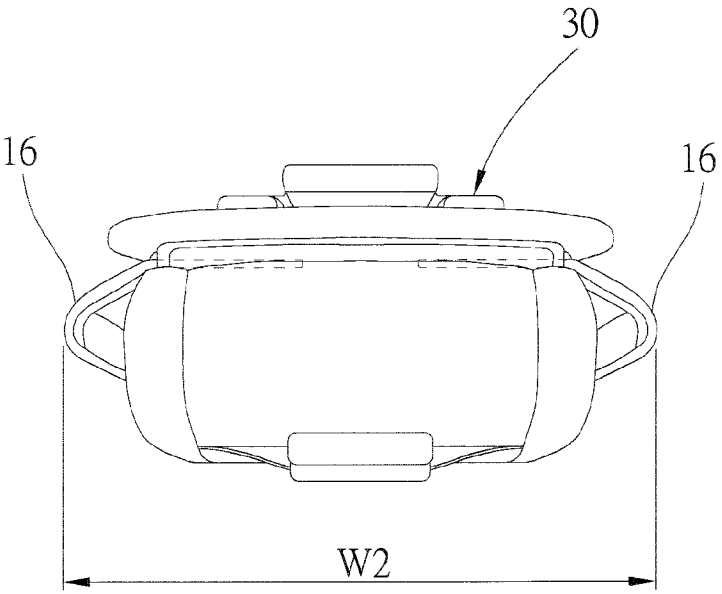
FIG. 9 is a top side view of the first preferred embodiment of the present invention, showing the combination type bag with wide width.

A width of the combination type bag 100 is adjustable as well by changing a connecting location of the first connector 42 and the second connector 44 on the side fabric portions 16. If the side fabric portions 16 have more parts inserted into the openings 36, it would reduce the width W1 of the combination type bag 100 (FIG. 8); on the contrary, if the side fabric portions 16 have less parts inserted into the openings 36, it would increase the width W2 (FIG. 9). In other words, the width of the combination type bag 100 is adjustable by changing lengths of the side fabric portions 16 inserted into the openings 36. As a result, a capacity of the combination type bag 100 is adjustable.

The covering fabric 34 of the secondary bag member 34 allows the first and the second connectors 42, 44 only disengage by pulling the side fabric portions 16 out of the openings 36. It takes some effort to disengage them in this way when the connecting unit 40 is Velcro, so the side fabric portions 16 would be connected to the secondary bag member 30 firmly.

Figure 2:
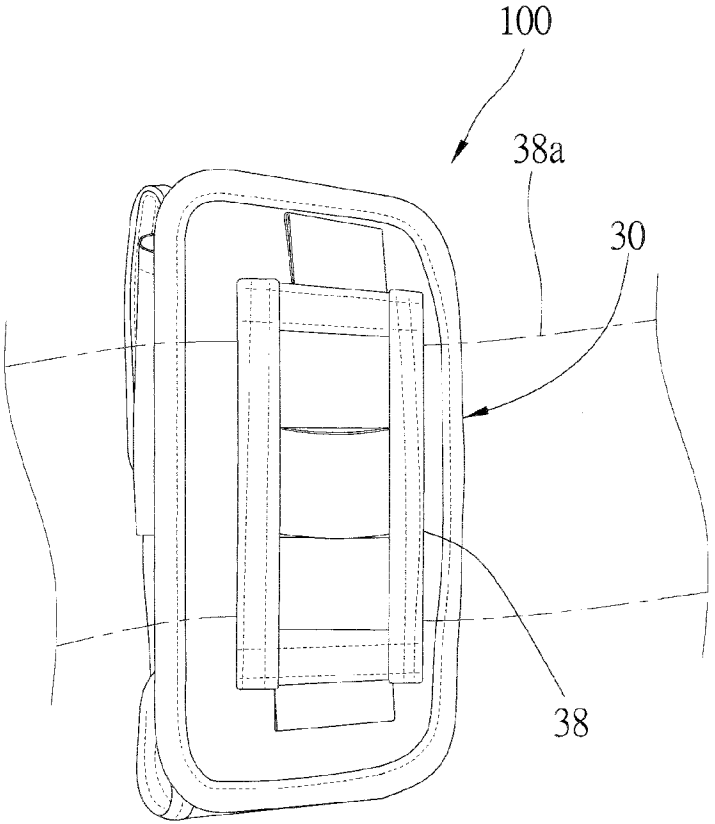
FIG. 2 is a rear respective view of the first preferred embodiment of the present invention.

As shown in FIG. 2, the secondary bag member 30 is provided with a fastener 38, which is a band with opposite ends sewed on an outer side of the secondary bag member 30 (the base fabric 32), to let the combination type bag 100 can be hung on a belt 38*a*.

Figure 10:
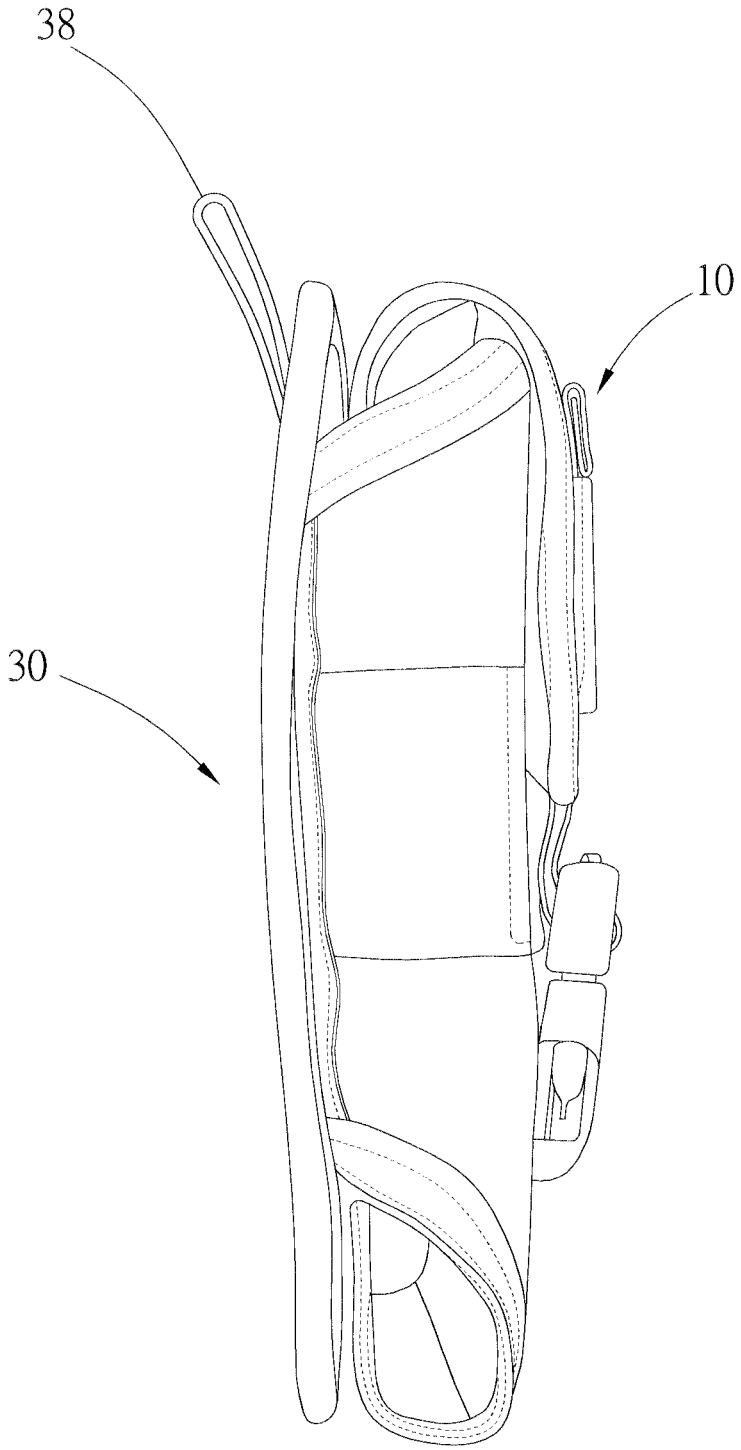
FIG. 10 is a left side view of a second preferred embodiment of the present invention, showing the belt connected to the top of the secondary bag member.

FIG. 10 shows another fastener 38, which is a loop connected to a top of the secondary bag member 30 to be held by a user or hung on any object.

Figure 11:
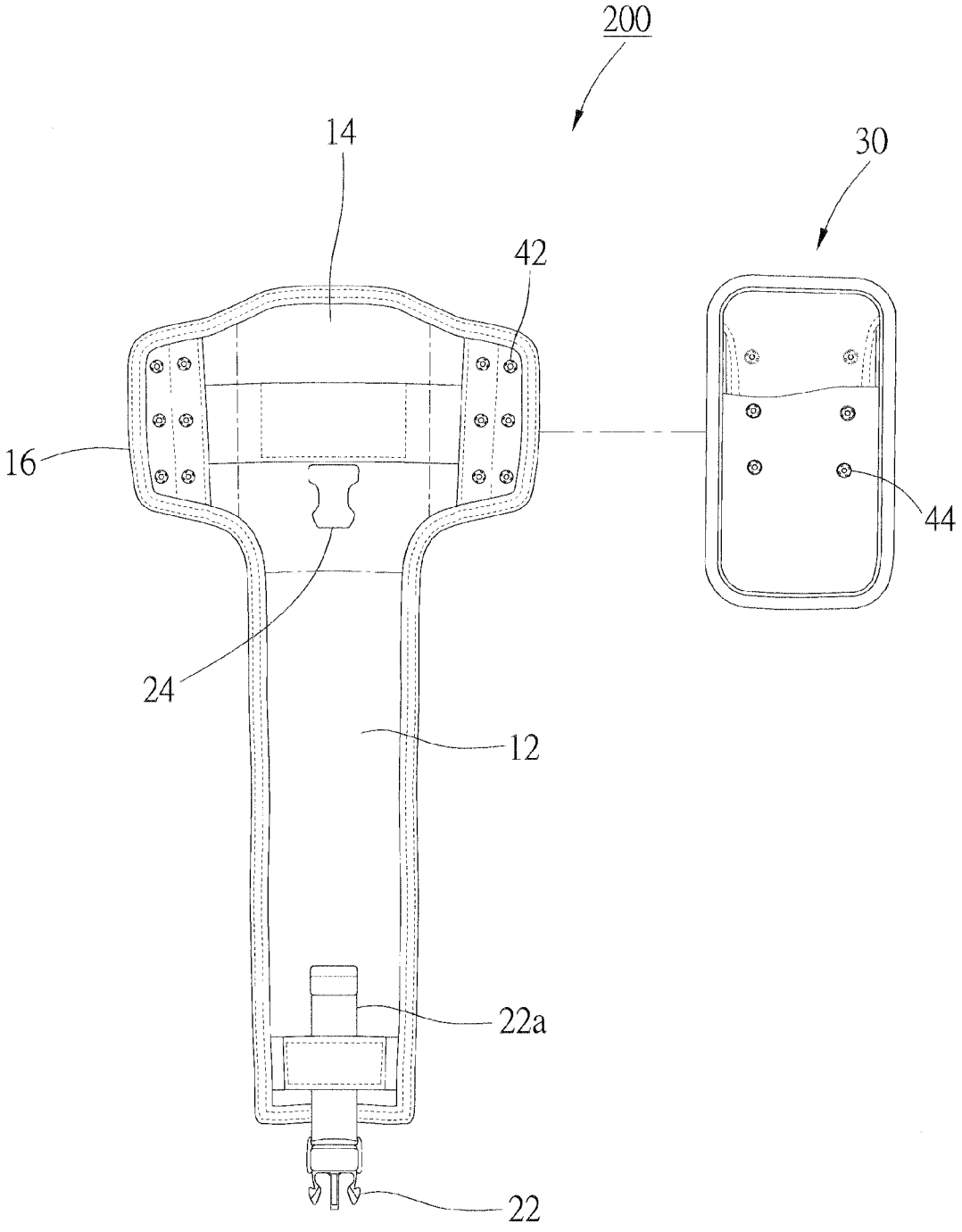
FIG. 11 is an exploded view of a third preferred embodiment of the present invention, showing the combination type bag with the buckle.

FIG. 11 shows another combination type bag 200, in which the connecting unit 40 has a plurality of snap buttons, and the first and the second connectors are the sockets and the stubs of the snap buttons. The snap buttons have the same function as Velcro.

It must be pointed out that the embodiments described above are only some preferred embodiments of the present invention. All equivalent structures and methods which employ the concepts disclosed in this specification and the appended claims should fall within the scope of the present invention.

What is claimed is:

1. A combination type bag, comprising:

a main bag member, which is made of a flexible fabric, having a first fabric portion, a second fabric portion, and two side fabric portions, wherein the first fabric portion is connected to an end of the second fabric portion, and the side fabric portions are connected to opposite ends of the second fabric portion symmetrically;

a coupling unit having a first coupler and a second coupler detachably engaged with each other, wherein the first coupler is provided on the first fabric portion, and the second coupler is provided on the second fabric portion;

a secondary bag member having a base fabric and a covering fabric connected with each other to form a space therebetween, wherein the secondary bag member has two openings to be entrances of the space; and a connecting unit having two first connectors and a second connector detachably engaged with each other, wherein the first connectors are provided on the side fabric portions of the main bag member respectively, and the second connector is detachably provided on the base fabric of the secondary bag member and is in the space;

wherein the main bag member is folded to have the first fabric portion and the second fabric portion overlapped and the first coupler engaged with the second coupler; and then the side fabric portions are inserted into the space of the secondary bag member via the openings to have the first connectors engaged with the second connector.

2. The combination type bag of claim 1, further comprising a fastener connected to the secondary bag member, wherein the fastener is a band with opposite ends connected to the secondary bag member.

3. The combination type bag of claim 1, further comprising a fastener connected to the secondary bag member, wherein the fastener is a loop connected to a top of the secondary bag member.

4. The combination type bag of claim 1, further comprising a fastener connected to the base fabric of the secondary bag member opposite to the second connector.

5. The combination type bag of claim 1, wherein the first connector and the second connector of the connecting unit are loops and hooks of Velcro.

6. The combination type bag of claim 1, wherein the first connector and the second connector of the connecting unit are sockets and studs of snap buttons.

7. The combination type bag of claim 1, wherein the coupling unit further includes a belt with an end connected to the first fabric portion of the main bag member, and the first coupler of the coupling unit is provided on the belt.

8. The combination type bag of claim 7 wherein the first coupler is movable on the belt.

9. The combination type bag of claim 1, wherein the first coupler and the second coupler of the coupling unit are a plug and a socket of a side release buckle.

* * * * *